US009966686B2

(12) United States Patent
Huang

(10) Patent No.: US 9,966,686 B2
(45) Date of Patent: May 8, 2018

(54) CONNECTOR HAVING A SCRATCHING TERMINAL

(71) Applicant: Tyco Electronics (Shanghai) Co. Ltd., Shanghai (CN)

(72) Inventor: Liang Huang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days. days.

(21) Appl. No.: 15/442,230

(22) Filed: Feb. 24, 2017

(65) Prior Publication Data

US 2017/0250487 A1 Aug. 31, 2017

(30) Foreign Application Priority Data

Feb. 26, 2016 (CN) ..... 2016 1 0107435

(51) Int. Cl.

| | |
|---|---|
| ***H01R 24/00*** | (2011.01) |
| ***H01R 13/24*** | (2006.01) |
| ***H01R 24/58*** | (2011.01) |
| ***H01R 13/03*** | (2006.01) |
| *H01R 103/00* | (2006.01) |

(52) U.S. Cl.

CPC ..... *H01R 13/2464* (2013.01); *H01R 13/03* (2013.01); *H01R 24/58* (2013.01); *H01R 2103/00* (2013.01)

(58) Field of Classification Search

CPC ..... H01R 13/02; H01R 24/60; H01R 24/62
USPC ..... 439/660, 60, 181, 387, 520, 931
See application file for complete search history.

(56) References Cited

U.S. PATENT DOCUMENTS

| | | | | | |
|---|---|---|---|---|---|
| 4,747,783 | A * | 5/1988 | Bellamy | ..... | H01R 13/03 200/268 |
| 5,989,053 | A * | 11/1999 | Wheeler | ..... | H01R 13/04 439/387 |
| 6,115,260 | A * | 9/2000 | Nakajima | ..... | H05K 1/117 174/260 |

* cited by examiner

*Primary Examiner* — Phuong Dinh
(74) *Attorney, Agent, or Firm* — Barley Snyder

(57) ABSTRACT

A connector is disclosed. The connector has an insulation body, a conductive terminal disposed on the insulation body, and a scratching terminal disposed on the insulation body. The scratching terminal is electrically isolated from the conductive terminal. An electrical contact of a mating conductive terminal of a mating connector comes into electrical contact with the scratching terminal before electrically contacting the conductive terminal during mating with the connector.

16 Claims, 3 Drawing Sheets

CONNECTOR HAVING A SCRATCHING TERMINAL

CROSS-REFERENCE TO RELATED APPLICATION

This application claims the benefit of the filing date under 35 U.S.C. § 119(a)-(d) of Chinese Patent Application No. 201610107435.5, filed on Feb. 26, 2016.

FIELD OF THE INVENTION

The present invention relates to a connector, and more particularly, to an electrical connector of a connector assembly.

BACKGROUND

In two connectors known in the art adapted to be mated with each other, a first connector has a plug, and a second connector has an insertion cavity; the plug is adapted to be inserted into the insertion cavity. A conductive terminal of the first connector is provided on the plug. A resilient arm of a conductive terminal of the second connector extends into the insertion cavity so as to elastically come into electrical contact with the conductive terminal of the first connector provided on the plug inserted into the insertion cavity.

During coupling of the first connector with the second connector, an electrical contact on the resilient arm slides a predetermined distance (a scratching distance) on a surface of the conductive terminal of the first connector, so as to scratch off an oxide layer on the surface of the conductive terminal of the first connector and ensure a good electrical contact. In the prior art, the conductive terminal of the first connector has to have a sufficient length in order to ensure that enough scratching distance exists between the conductive terminal of the first connector and the conductive terminal of the second connector. The conductive terminal of the first connector is thus relatively long, which results in a reduced resonant frequency, impedance mismatching, and reduced signal transmission performance when the first connector and the second connector are mated.

SUMMARY

An object of the invention, among others, is to provide a connector which improves resonance frequency and optimizes impendence when mated with another connector without reducing an effective scratching distance. The disclosed connector has an insulation body, a conductive terminal disposed on the insulation body, and a scratching terminal disposed on the insulation body. The scratching terminal is electrically isolated from the conductive terminal. An electrical contact of a mating conductive terminal of a mating connector comes into electrical contact with the scratching terminal before electrically contacting the conductive terminal during mating with the connector.

BRIEF DESCRIPTION OF THE DRAWINGS

The invention will now be described by way of example with reference to the accompanying Figures, of which.

DETAILED DESCRIPTION OF THE EMBODIMENTS

Figure 1:
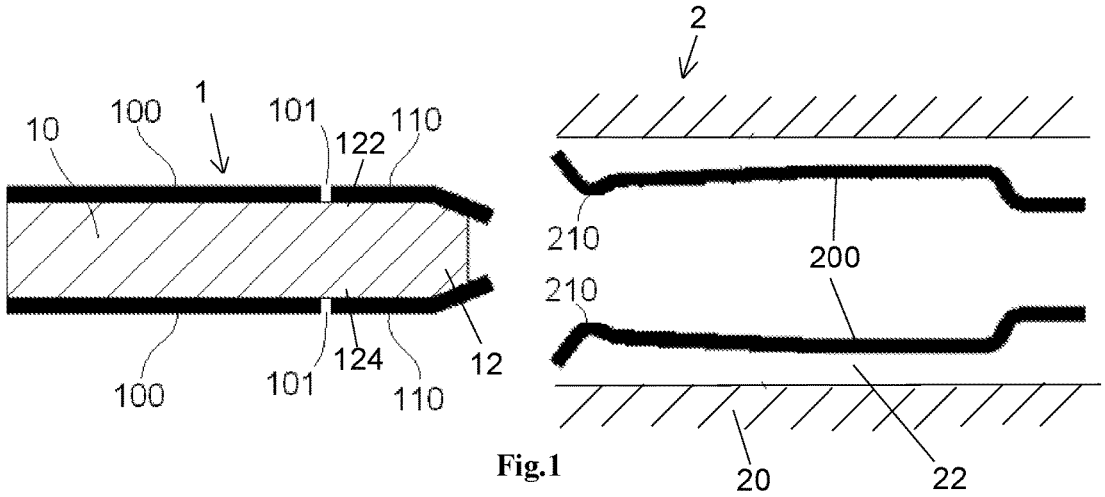
FIG. 1 is a sectional side view of a first connector and a second connector according to the invention in a separated position.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

Figure 2:
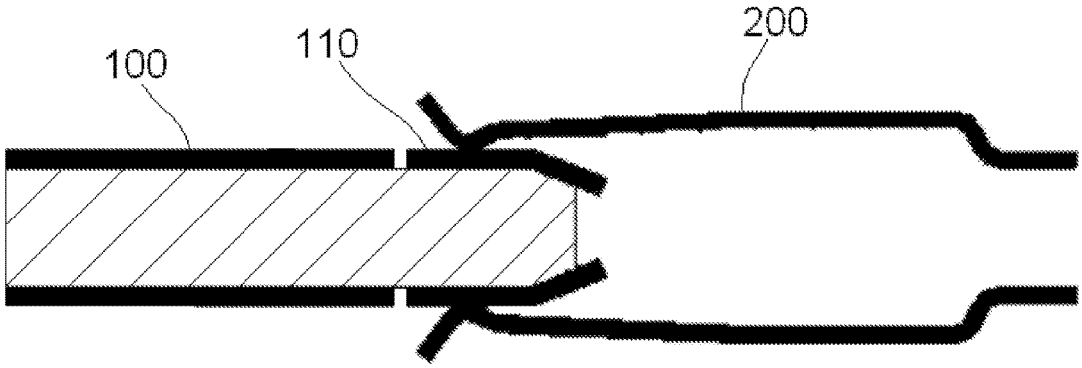
FIG. 2 is a sectional side view of the first connector and the second connector in an intermediate position.
Figure 3:
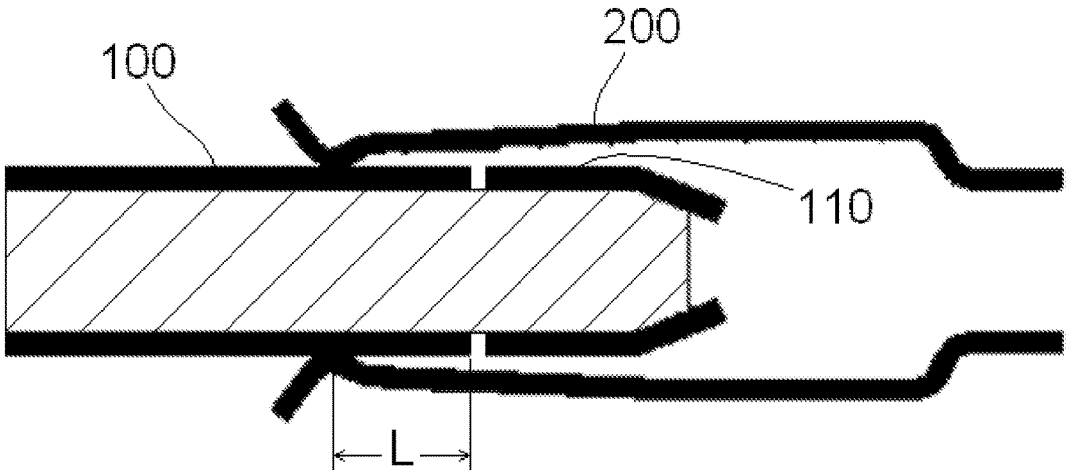
FIG. 3 is a sectional side view of the first connector and the second connector in a fully mated position.

A connector assembly according to the invention is shown generally in FIGS. 1-3. The connector assembly includes a first connector 1 and a second connector 2.

The first connector 1, as shown in FIG. 1, includes a first insulation body 10 and a first conductive terminal 100 disposed on the first insulation body 10. In the shown embodiment, the first connector 1 further includes a scratching terminal 110 provided on the first insulation body 10 and electrically isolated from the first conductive terminal 100 by a clearance 101. The clearance 101 has a predetermined width between adjacent end surfaces of the first conductive terminal 100 and the scratching terminal 110 so as to electrically isolate the first conductive terminal 100 from the scratching terminal 110. In the shown embodiment, the first connector 1 includes a plurality of the first conductive terminals 100 and a plurality of scratching terminals 110 corresponding to the plurality of the first conductive terminals 100.

The second connector 2, as shown in FIG. 1, includes a second insulation body 20 and a second conductive terminal 200 disposed on the second insulation body 20. In an exemplary embodiment, the second conductive terminal 200 extends into and is held on inner walls of an insertion cavity 22 formed in the second insulation body 20. In the shown embodiment, the second conductive terminal 200 is a resilient arm having an electrical contact 210. In the shown embodiment, the second connector 2 includes a plurality of the second conductive terminals 200 corresponding to the plurality of the first conductive terminals 100.

The first insulation body 10, as shown in FIG. 1, includes a convex end 12 adapted to be inserted into the insertion cavity 22 of second insulation body 20 of the second connector 2. The scratching terminal 110 and the first conductive terminal 100 are mounted on the convex end 12 of the first insulation body 10. In the shown embodiment, the convex end 12 of the first insulation body 10 has upper terminal retaining grooves 122 formed on an upper side surface thereof and lower terminal retaining grooves 124 formed on a lower side surface thereof; the plurality of the first conductive terminals 100 and the plurality of scratching terminals 110 are retained in the upper terminal retaining grooves 122 and the lower terminal retaining grooves 124 of the convex end 12, respectively.

In an exemplary embodiment, the first conductive terminal 100, the second conductive terminal 200 and the scratching terminal 110 are made from the same or different conductive materials. The first conductive terminal 100, the second conductive terminal 200 and the scratching terminal 110 may be made from the same or different metal materials, for example, all may be made from copper.

The first connector 1 is adapted to be inserted into the second connector 2, as described in greater detail below with reference to FIGS. 1-3.

When the first connector 1 is inserted into the second connector 2, the electrical contact 210 of the second conductive terminal 200 comes into electrical contact with the scratching terminal 110, as shown in FIG. 2, before electrically contacting the first conductive terminal 100, as shown in FIG. 3. During insertion of the first connector 1 into the second connector 2, as shown in FIGS. 1 and 2, the scratching terminal 110 and the first conductive terminal 100 keep stationary with respect to the first insulation body 10.

In a fully mated position of the first connector 1 and the second connector 2 shown in FIG. 3, the electrical contact 210 of the second conductive terminal 200 resiliently comes into electrical contact with the first conductive terminal 100. In the fully mated position, the electrical contact 210 of the second conductive terminal 200 is spaced a distance from the clearance 101 by a predetermined length L greater than zero. That is, the distance between the contact position of the first conductive terminal 100 and the electrical contact 210 of the second conductive terminal 200 and the clearance 101 is the predetermined length L. The size of the predetermined length L may be determined based on the lengths of the first and second conductive terminals 100 and 200. The predetermined length L may, for example, be in the range of 0.5 mm to 2 mm. Because the electrical contact 210 is separated from the clearance 101 by the predetermined length L, if an error between an intended insertion depth and an actual insertion depth is less than the predetermined length L, the electrical contact between the first conductive terminal 100 and the electrical contact 210 is still ensured.

By providing the scratching terminal 110 electrically isolated from the first conductive terminal 100, a sufficient scratching distance is allowed between the first connector 1 and the second connector 2. A length of the first conductive terminal 100 may be shortened, thereby improving a resonance frequency when the first connector 1 and the second connector 2 are mated together, as described with reference to FIG. 4 below. The shortened length of the first conductive terminal 100 also optimizes an impedance when the first connector 1 and the second connector 2 are mated together, as described with reference to FIG. 5 below, and improves a signal transmission performance.

Figure 4:
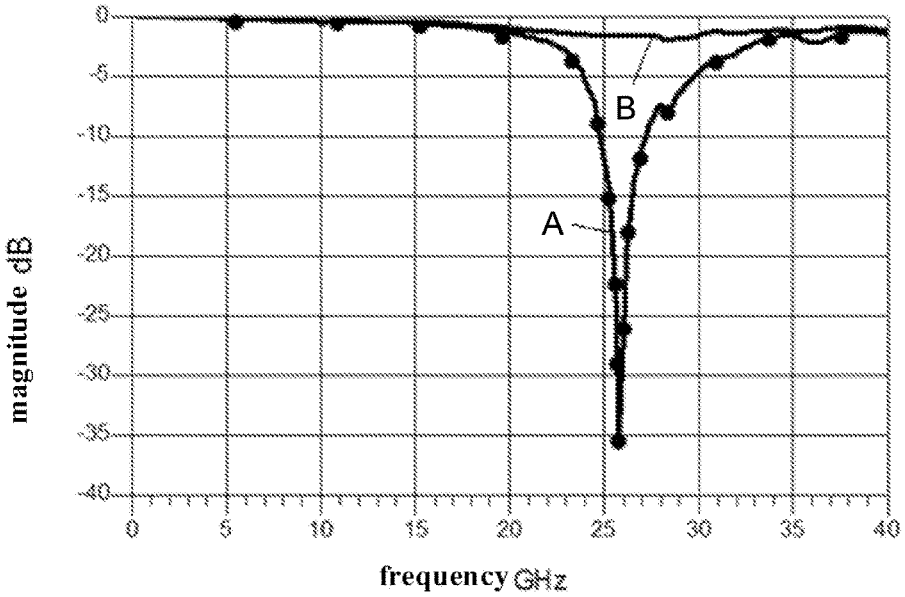
FIG. 4 is a resonance curve of the first connector and the second connector.

As shown in FIG. 4, the curve A indicates the resonance curve of a first connector and a second connector mated together in the prior art, and the curve B indicates the resonance curve of the first connector 1 and the second connector 2 mated together of the claimed invention shown in FIG. 3. The resonance frequency A of the first connector and the second connector mated together in the prior art is substantially equal to 25.6 GHz, whereas the resonance frequency B of the first connector 1 and the second connector 2 mated together of FIG. 3 is larger than 40 GHz, thereby dramatically improving resonance frequency when the first connector 1 and the second connector 2 are mated together.

Figure 5:
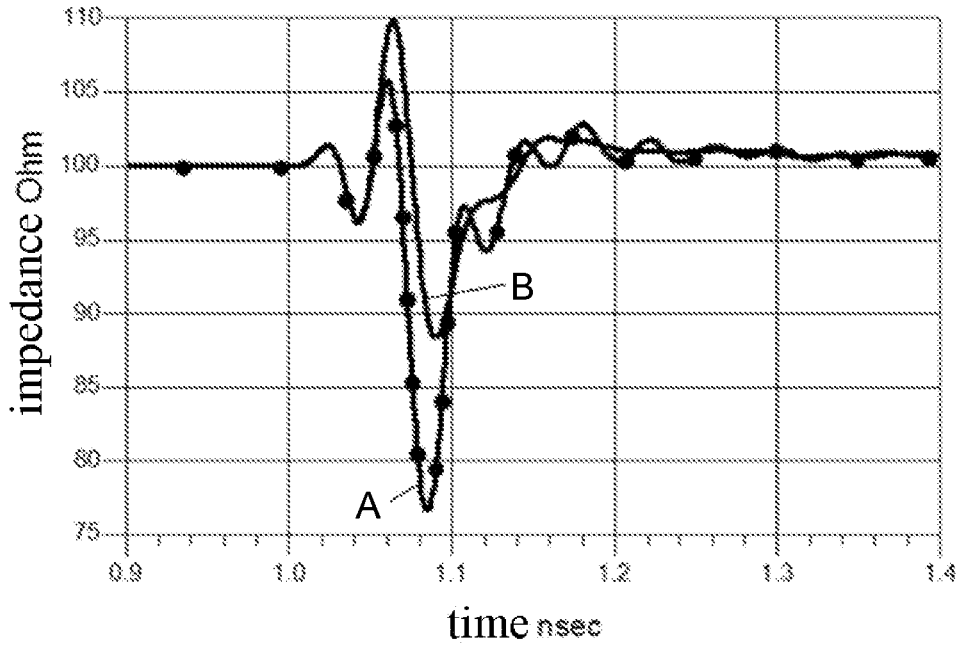
FIG. 5 is an impedance curve of the first connector and the second connector.

As shown in FIG. 5, the curve A indicates the impendence curve of the first connector and the second connector mated together in the prior art, and the curve B indicates the impendence curve of the first connector 1 and the second connector 2 mated together of FIG. 3. The impendence A of the first connector and the second connector mated together in the prior art is substantially equal to 76.6 ohm, whereas the impendence B of the first connector 1 and the second connector 2 mated together of FIG. 3 is substantially equal to 88.5 ohm, thereby dramatically optimizing the impendence curve when the first connector 1 and the second connector 2 are mated together.

What is claimed is:

1. A connector, comprising:

an insulation body having a convex end;

a conductive terminal disposed on the convex end of the insulation body; and a scratching terminal disposed on the convex end of the insulation body and electrically isolated from the conductive terminal, the convex end of the insulation body adapted to be inserted into an insertion cavity of a mating connector and an electrical contact of a mating conductive terminal of the mating connector coming into electrical contact with the scratching terminal before electrically contacting the conductive terminal during mating, the scratching terminal and the conductive terminal remaining stationary with respect to the insulation body during mating of the connector with the mating connector.

2. The connector of claim 1, wherein the conductive terminal and the scratching terminal are both made of a conductive material.

3. The connector of claim 2, wherein the conductive terminal and the scratching terminal are both made of a metal material.

4. The connector of claim 1, wherein a clearance with a predetermined width is disposed between adjacent end surfaces of the conductive terminal and the scratching terminal, the clearance electrically isolating the conductive terminal from the scratching terminal.

5. The connector of claim 4, wherein, when the connector is in a fully mated position with the mating connector, the electrical contact of the mating conductive terminal is spaced a distance from the clearance by a predetermined length greater than zero.

6. The connector of claim 1, wherein the connector has a plurality of conductive terminals and a plurality of scratching terminals corresponding to the plurality of conductive terminals.

7. The connector according to claim 6, wherein the convex end has a plurality of upper terminal retaining grooves formed on an upper side surface thereof and a plurality of lower terminal retaining grooves formed on a lower side surface thereof.

8. The connector according to claim 7, wherein the plurality of conductive terminals and the plurality of scratching terminals are retained in the plurality of upper terminal retaining grooves and the plurality of lower terminal retaining grooves of the convex end, respectively.

9. A connector assembly, comprising:

a first connector having a first insulation body with a convex end, a first conductive terminal disposed on the convex end of the first insulation body, and a scratching terminal disposed on the convex end of the first insulation body and electrically isolated from the first conductive terminal; and a second connector adapted to be mated with the first connector and having a second insulation body and a second conductive terminal disposed on the second insulation body, the second conductive terminal is a resilient arm extending into and held on inner walls of an insertion cavity of the second connector and including an electrical contact electrically contacting the scratching terminal before electrically contacting the first conductive terminal during mating, the convex end of the first insulation body adapted to be inserted into the insertion cavity and the scratching terminal and first conductive terminal remaining stationary with respect to the first insulation body during mating of the first connector with the second connector.

10. The connector assembly of claim 9, wherein the first conductive terminal, the second conductive terminal, and the scratching terminal are each made of a conductive material.

11. The connector assembly of claim 10, wherein first conductive terminal, the second conductive terminal, and the scratching terminal are each made of a metal material.

12. The connector assembly of claim 9, wherein a clearance with a predetermined width is disposed between adjacent end surfaces of the first conductive terminal and the scratching terminal, the clearance electrically isolating the first conductive terminal from the scratching terminal.

13. The connector assembly of claim 12, wherein, when the first connector is in a fully mated position with the second connector, the electrical contact of the second conductive terminal is spaced a distance from the clearance by a predetermined length greater than zero.

14. The connector assembly of claim 9, wherein the first connector has a plurality of first conductive terminals and a plurality of scratching terminals corresponding to the plurality of first conductive terminals, and the second connector has a plurality of second conductive terminals corresponding to the plurality of first conductive terminals.

15. The connector assembly of claim 14, wherein the convex end has a plurality of upper terminal retaining grooves formed on an upper side surface thereof and a plurality of lower terminal retaining grooves formed on a lower side surface thereof.

16. The connector assembly of claim 15, wherein the plurality of first conductive terminals and the plurality of scratching terminals are retained in the plurality of upper terminal retaining grooves and the plurality of lower terminal retaining grooves of the convex end, respectively.

* * * * *